United States Patent [19]

Monte et al.

[11] 4,324,164

[45] Apr. 13, 1982

[54] TONE CHANGING MEANS FOR PERCUSSION INSTRUMENTS

[76] Inventors: Charles Monte, 570 Texas St., San Francisco, Calif. 94107; Barry E. Carter, 2514-32nd Ave., San Francisco, Calif. 94116

[21] Appl. No.: 865,960

[22] Filed: Dec. 30, 1977

[51] Int. Cl.[3] ..... G10F 1/02; G10H 3/00

[52] U.S. Cl. ..... 84/1.04; 84/34; 84/1.06

[58] Field of Search ..... 84/1.04, 1.06, 1.09, 84/1.14, 1.15, 1.16, DIG. 7, DIG. 8, DIG. 12, DIG. 25, 33, 34, 21

[56] References Cited

U.S. PATENT DOCUMENTS

| | | | |
|---|---|---|---|
| 1,722,979 | 7/1929 | Hammond | 84/33 |
| 2,456,321 | 12/1948 | Rhodes | 84/404 |
| 2,949,052 | 8/1960 | Andersen | 84/1.04 |
| 2,952,179 | 9/1960 | Andersen | 84/1.04 |
| 2,986,963 | 6/1961 | Jones | 84/1.04 |
| 3,049,958 | 8/1962 | Benioff | 84/DIG. 24 |
| 3,384,699 | 5/1968 | Rhodes | 84/1.14 |
| 3,644,656 | 2/1972 | Fender et al. | 84/1.04 |
| 3,693,491 | 9/1972 | Creager | 84/1.04 X |
| 3,935,783 | 2/1976 | Machanian et al. | 84/1.12 X |
| 3,937,115 | 2/1976 | Staley | 84/1.24 |

*Primary Examiner*—J. V. Truhe
*Assistant Examiner*—Forester W. Isen
*Attorney, Agent, or Firm*—George White; David B. Harrison

[57] ABSTRACT

In the herein illustrated embodiment the harp or tone generator assembly of the piano is supported pivotally at one end so as to pivot in a substantially horizontal plane on its support, and a mechanism manipulated by the player shifts the movable end of the harp thereby to shift the position of the tone generators in the harp relatively to the percussion hammers, so that while the keys of the piano are depressed for playing, the player can selectively change the tone at will; an amplifying circuit compensates for the loss of volume due to the shifting and to the resultant change of the striking line.

8 Claims, 10 Drawing Figures

TONE CHANGING MEANS FOR PERCUSSION INSTRUMENTS

BACKGROUND OF THE INVENTION

In percussion musical instruments a tone generator is struck by percussion means to generate vibration to be translated into sound. The term "tone generator" as herein used is intended to include vibratory tone producers or vibratory sound sources of percussion musical instruments vibrated by impacts thereon and producing sound acoustically or electrically.

As an example, an electric piano basically consists of tuned reeds called tone generators which are struck with hammers which latter are actuated in the usual ways by keys so that when the keys are depressed the respective corresponding hammers strike the respective tone generators. In an electric piano the vibrations of the tone generators are sensed by magnetic pick-ups and thus an electric signal is produced which is amplified and translated by the usual electric circuit into signals to drive a loudspeaker or loudspeakers.

The primary object of this invention is to selectively shift the relative position between the tone generator and the impactor so as to vary the location of the impact on the tone generator, namely, shifting the striking line at will during playing so that a new type of sound is generated by the simple manipulation of a foot pedal or the like so that the tone change is controlled by the player. The shifting of the striking line alters the wave shape, the harmonic structure and the volume level of the sound generated by the percussion instrument. In the herein specification "tone change" refers to these alterations of the tone.

Another object of the invention is to divide the wiring of the tone generators so as to separate the electronic circuit of about the first octave at the bass end of the keyboard and the last one and one-half octaves at the treble end so they are separately operated electronically because the notes in those areas are hardly affected by the "tone change"; but the remaining tone generators in the middle are affected by the shifting of the harp in various degrees, namely, each note has an individual response based on its timbre, volume and tone adjustment, therefore, an amplifying circuit is utilized to compensate for the corresponding loss of their overall volume.

Further object of the invention is to provide a simple and facile mechanism for changing the relation between the tone generator assembly and the percussion elements, such as the hammers, for changing the tone of the sound selectively to any degree desired by the player during the playing of the musical instrument.

DETAILED DESCRIPTION

Figures 1, 2:
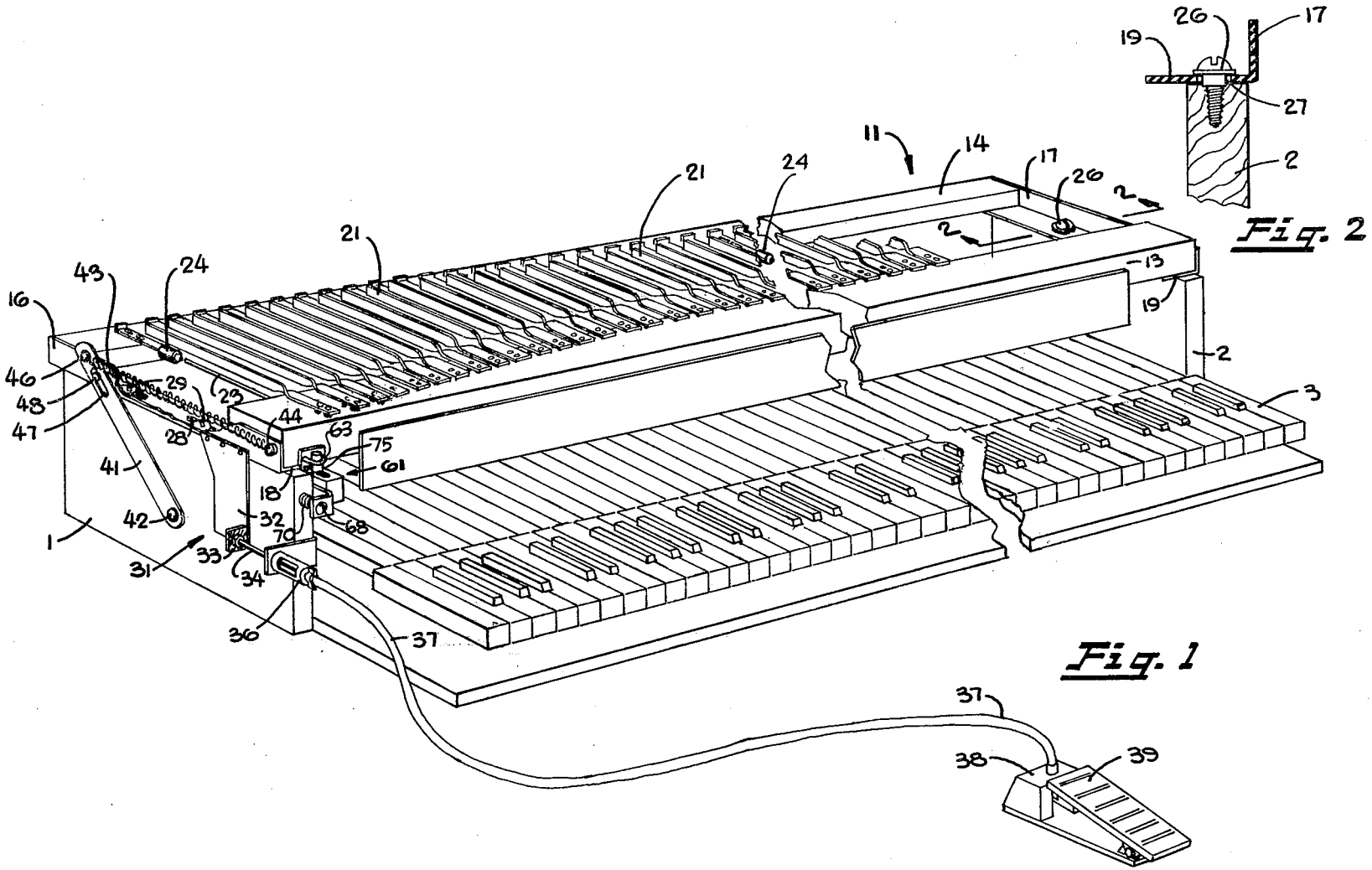
FIG. 1 is a perspective view of an electrical piano showing the tone generator assembly on the shiftable frame and a pedal operated mechanism for shifting the assembly.
FIG. 2 is a fragmental sectional view of the pivot of the shiftable assembly frame, the section being taken on lines 2—2 of FIG. 1.

In general, in the herein illustration, a piano has support blocks 1 and 2, the usual keys 3, herein illustrated as pivoted on a pivot 4. Each key 3 has a so-called key pedestal 6 at its inner end. The key pedestal engages the hammer butt 7 of a hammer 8. The hammer butt 7 swings around a fixed pivot 9 from the position shown in full lines into the position shown in broken lines in FIG. 3.

The harp frame 11 of the generator assembly includes a front rail 13 and a parallel rear rail 14 connected at the ends thereof respectively by end plates 16 and 17. Each end plate is of angle cross-section, and the base flanges 18 and 19 respectively are adjustably connected to the respective support blocks 1 and 2.

Figure 3:
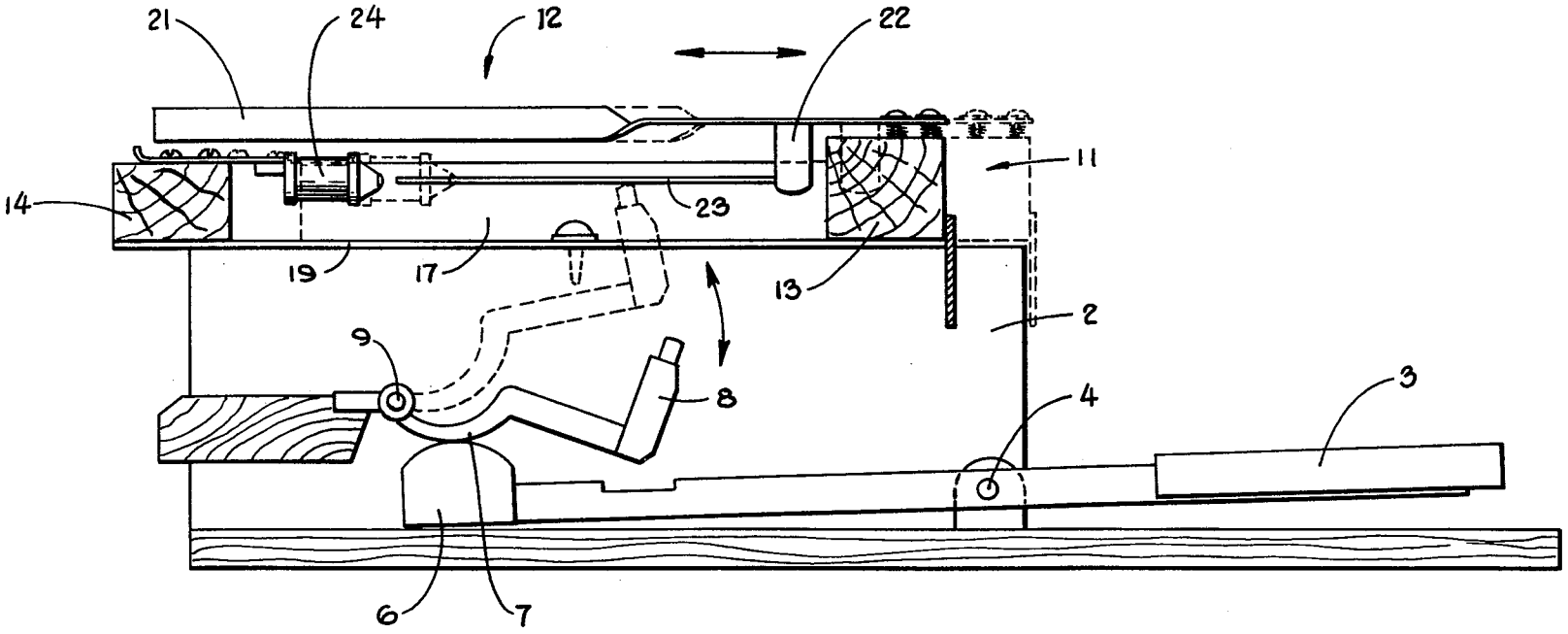
FIG. 3 is a cross-sectional view of assembly frame on the support of the piano showing the hammer in retracted position, and in broken lines in striking position, and showing in broken lines the shifted position of the tone generators.

On the front rail 13 and the rear rail 14 are supported the individual tone generators. As illustrated in FIG. 3, each tone generator includes a suitable tone bar 21 secured to the front support rail 13. From the tone bar 21 extends a downward projection 22 to support an end of a tine 23 in the path of the adjacent hammer 8. On the rear rail 14 is supported a usual electronic pick-up 24 opposite the free end of each tine 23 and spaced therefrom at an adjusted distance for generating the suitable electric impulse in the piano which is translated by an electric circuit into sounds issuing from a loudspeaker.

One end of the harp frame 11, in this illustration at the treble end plate 17 is pivotally supported about a vertical axis. As shown in FIG. 2 a pivot screw 26 extends through a hole 27 in the base flange 19 so that the entire frame can be pivoted in the plane of the tops of the support blocks, in this instance in a horizontal plane. As shown in the left side of FIG. 1 the base flange 18 at the bass end has elongated longitudinally spaced slots 28 and guide screws 29 extend therethrough and are screwed into the support block 1 so as to guide the harp frame and limit the shifting of the same to the length of the slots 28, and also to prevent the lifting or raising of the base flange 18. In this manner the entire tone generator assembly can be shifted relative to the striking line of the hammers 8.

The manipulatable shifting mechanism 31 in this illustration is shown as being actuated by a pedal. However, the use of the term "manipulatable" in the herein application is intended to include manipulation by a foot pedal as well as a knee-operated pedal or electrical and other devices which can be actuated and controlled by the player during the playing of a musical percussion instrument.

Figure 4:
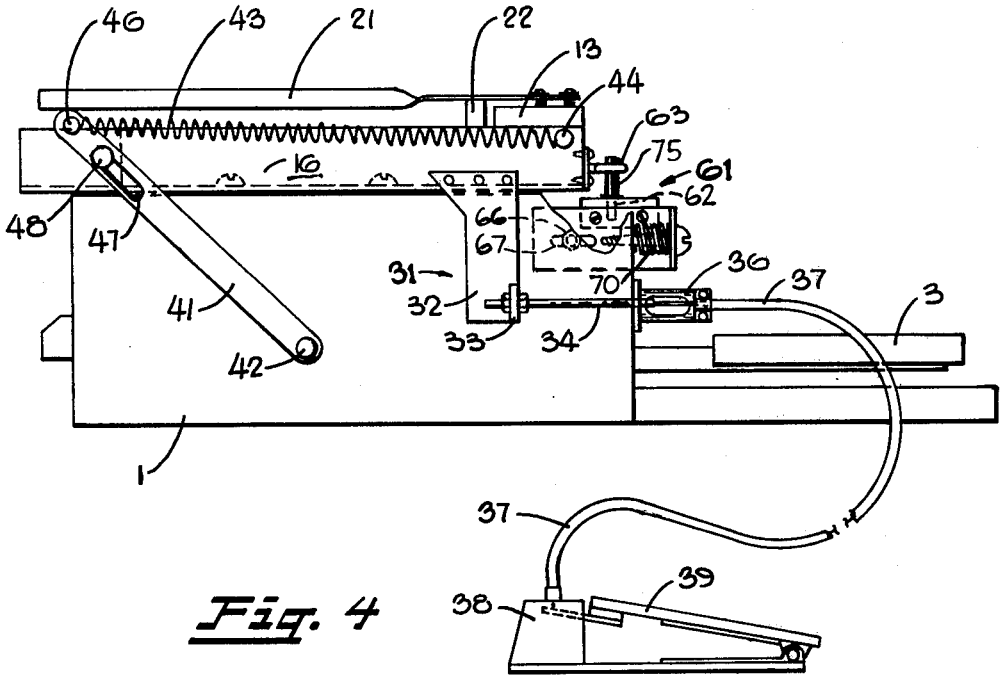
FIG. 4 is a side view of the electric piano showing the arrangement of the mechanism for shifting the tone generator assembly in initial position.
Figure 5:
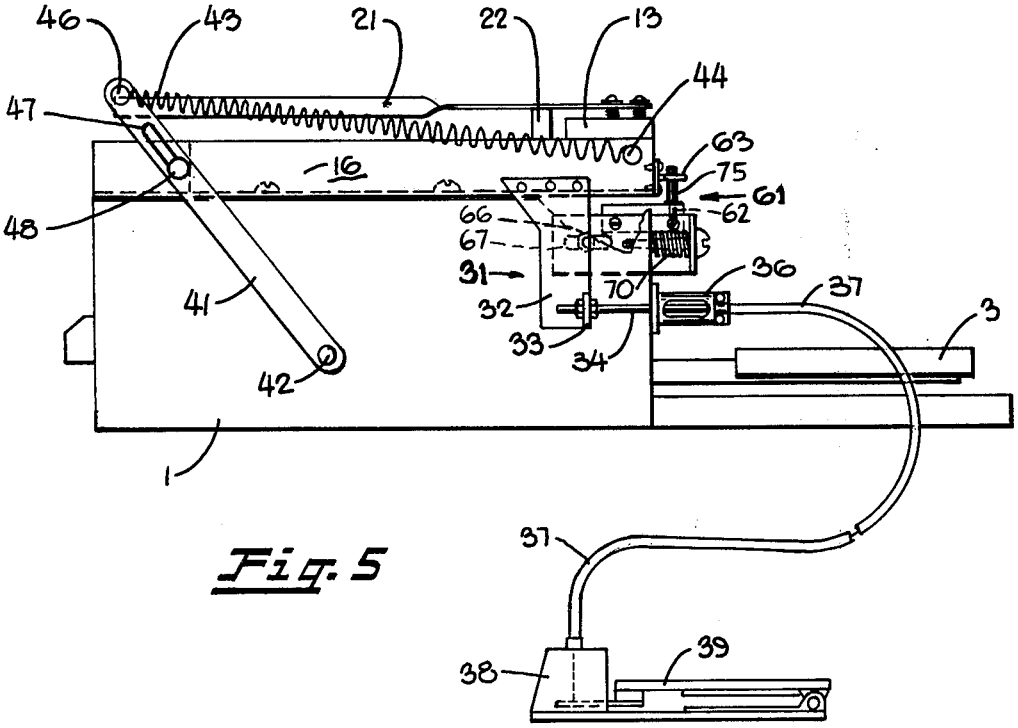
FIG. 5 is a side view of the piano showing the shifting mechanism in position after the generator assembly has been shifted.

In the herein illustrated embodiment a bracket plate 32 extends from the end plate 16 along the outer face of the support block 1. The lower portion of the plate 32 has an ear 33 to which is suitably fastened wire 34 extending through a guide 36 to which latter is secured the usual flexible cable 37. The cable is suitably connected to a floor block 38 through which the end of the wire 34 is connected to a foot pedal 39 pivoted in the usual manner, so that when the foot pedal is depressed it pulls the wire 34 and thereby pulls the plate 16 from the position shown in FIG. 4 into the position shown in FIG. 5 thereby shifting the entire harp assembly relatively to the striking line of the hammers to the extent the player depresses the pedal. In this manner, the shifting of the striking line of the tone generator assembly is controlled by the player.

A lever 41 has its lower end secured to the support block 1 on a pivot 42 and extends upwardly above the plate 16. A coil spring 43 is anchored at one end 44 to the end plate 16 and its other end to the upper end 46 of the lever 41. A longitudinal slot 47 in the lever 41 rides on a pin 48 to hold the lever 41 in a relative position. The pin 48 is fixed on the plate 16. The spring 43 normally urges the tone generator assembly into its initial position.

Figure 6:
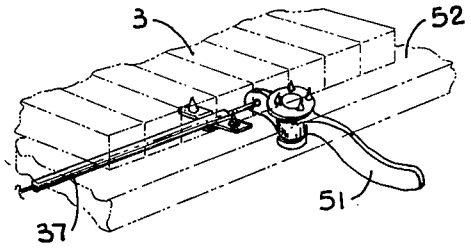
FIG. 6 is a view of a modified manipulating device.

In the modified form shown in FIG. 6 a knee lever 51 pivoted under the keyboard 52 of the piano is in a convenient position to be manipulated by the knee of the player. The wire 34 is connected to this key lever 51 in the same manner as the connection to the pedal whereby this pivoted key lever 51 pulls the wire 34 when manipulated by the player for shifting the tone generator assembly.

Figure 7:
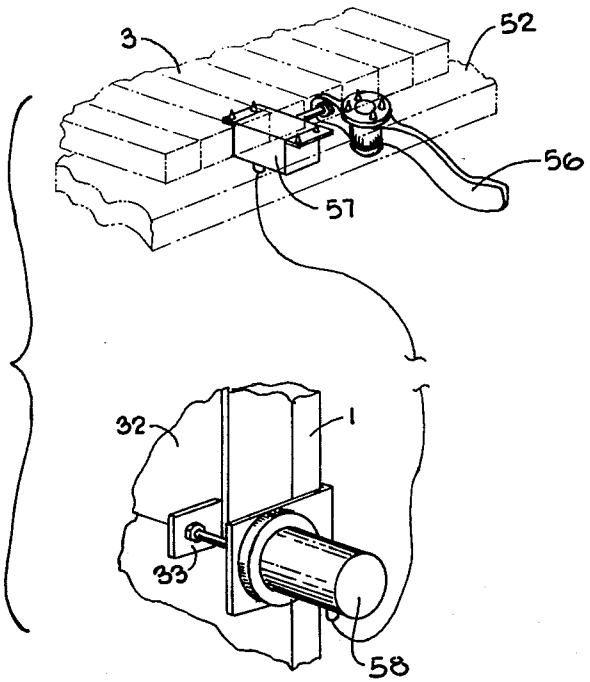
FIG. 7 is another modified form of the manipulating device.

Another modified form for manipulation is illustrated in FIG. 7 where a knee lever switch 56 pivoted under the keyboard 52 operates a rheostat 57 which regulates the circuit of a solenoid 58 on the support block 1 and is connected to the bracket 32 so that the bracket 32 is pulled by the solenoid 58 in accordance with the manipulation of the knee lever switch by the player.

Figure 8:
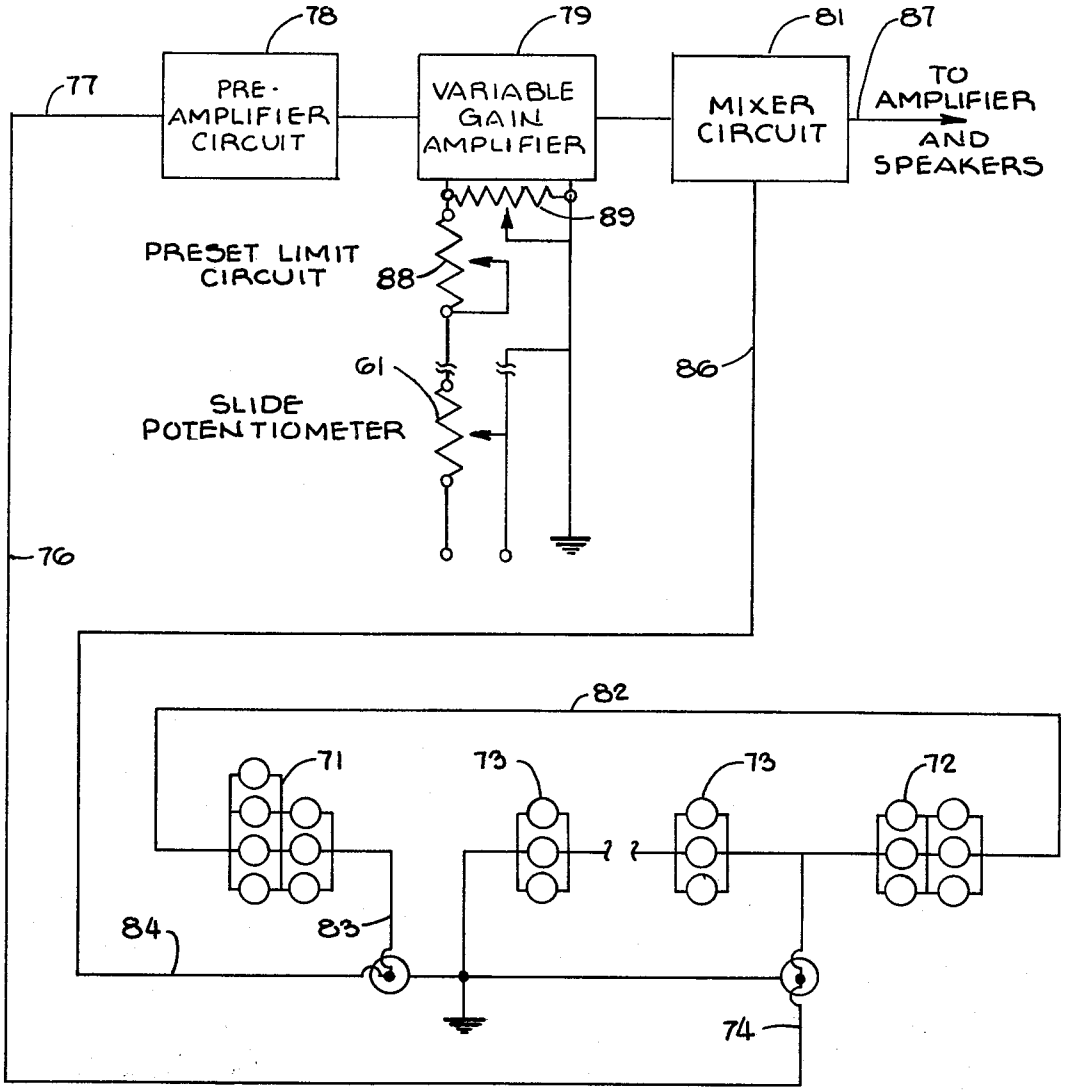
FIG. 8 is a wiring diagram for the variable amplification of the signals.

In all the forms of the manipulating means the degree of tone change is controlled by the player and thereby it changes the tone in accordance with shifting of the assembly including the tone generators and the pick-ups together. The constant relationship between the tine 23 and the adjacent pick-up 24 is not disturbed. The pivotal connection of the assembly is at its treble end and it is shifted at the bass end. The tonal effect of the shifting occurs on approximately the middle four-fifth of the keyboard range. It starts approximately at E two octaves below middle C to E two octaves above middle C. Upon shifting the assembly there is an accompanying loss of volume in this middle range and therefore an override pre-amplifier is used to keep the volume constant during the tone change. An illustrative electric circuit diagram in FIG. 8 shows the adjustable amplification. This amplifier circuit is controlled by a slide potentio-meter 61 adjustably mounted on the support block 1. A finger 62 of the potentio-meter 61 extends into a loop 63 on the front rail 13 of the harp frame so that it is being pushed and pulled according to the shifting of the harp assembly. In this manner as the finger 62 is shifted the potentio-meter 61 correspondingly adjusts the amplifying electric circuit in accordance with the degree of shifting.

Figure 9:
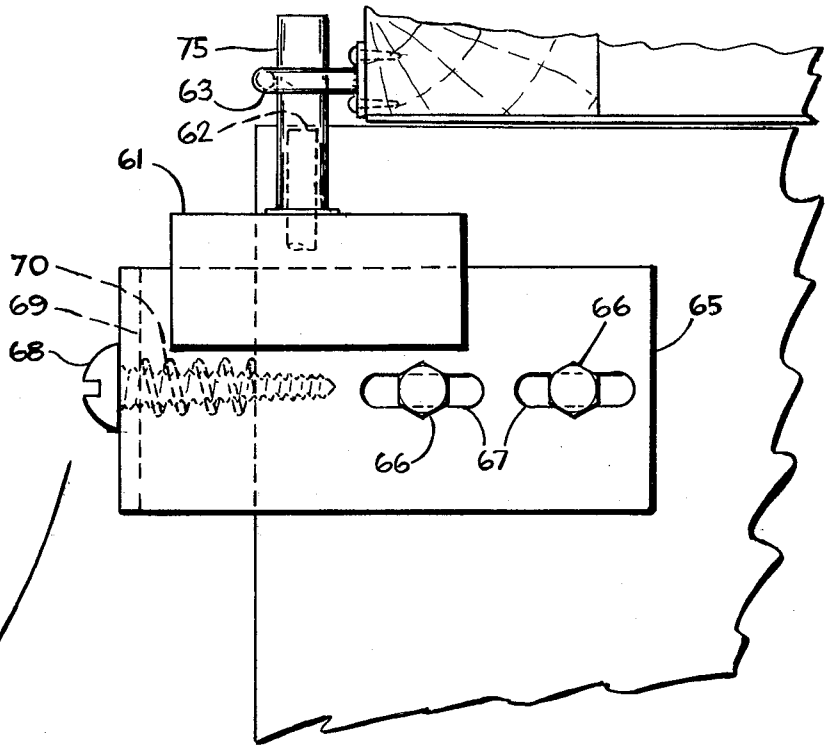
FIG. 9 is a view of the adjustable mounting of the potentiometer.

As shown in FIG. 9 the potentio-meter 61 is on a bracket 65. Screws 66 extend through spaced slots 67 and are screwed into the block 1 to hold the potentio-meter in adjusted position. For adjusting, an adjusting screw 68 through a flange 69 of the bracket 65 is screwed into or out of the front of the block 1. A spring 70 bears against the flange 69 so as to urge the flange away from the block 1 so as to facilitate manipulation. The screws 66 hold the bracket 65 in position and are loosened to permit adjustment. In FIG. 9 there is also shown a removable sleeve 75 over the finger 62 of the potentio-meter 61 so that the sleeve 75 can be removed when the harp is lifted for tuning and then replaced through the loop 63 after the harp is lowered. Thus the finger 62 is always out of the way of the harp frame.

Some tone generators at the bass end of the harp and some at the treble end are not materially affected by the shifting. Therefore, in the illustrative wiring diagram the pick-ups at these unaffected ends are separated from the pick-ups of the affected middle tone generators and then mixed with the amplified circuits.

In the wiring diagram the pick-ups 71 at the bass end and the pick-ups 72 at the treble end are illustrated as separated from the affected middle pick-ups 73. The line 74 of the affected middle note pick-ups 73 is connected by line 76 to the imput line 77 of a pre-amplifying circuit 78 which, in turn, is connected to a variable gain amplifier 79. The pre-amplifying circuit 78 is a high impedance circuit with 180° phase change of the impulse conveyed to it as transmitted to the variable gain amplifier 79, which also has a 180° phase change. The variable gain amplifier circuit 79 is connected to a mixing circuit 81. The groups of pick-ups 71 and 72 of the tone generators at the bass and the treble end are connected to one another as represented by a line 82. All three groups are connected through a line 83 and another line 84 to the imput 86 of the mixing circuit 81 whereby the signals conveyed from the pick-ups at the bass and the treble ends are mixed with the amplified vibrations picked up by the pick-ups 73 in the middle portion, and the mixed signal is then transmitted through line 87 to the usual electronic circuit of the electric piano and to the loudspeakers not shown.

Figure 10:
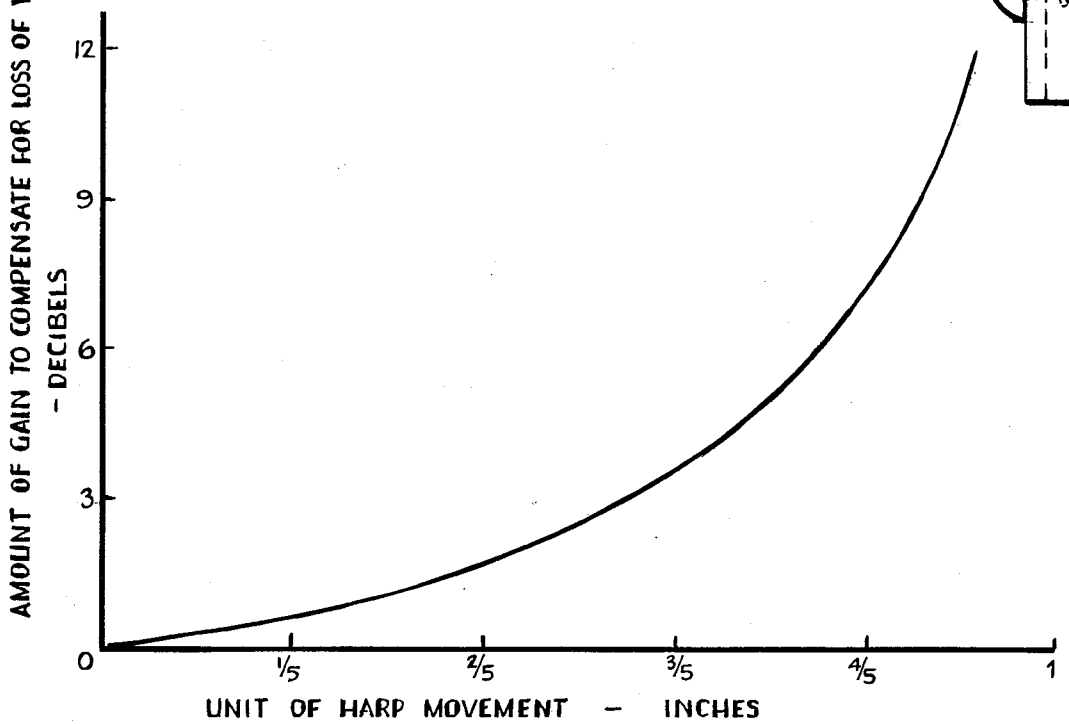
FIG. 10 is a curve illustrating the gain to compensate loss of volume caused by the harp movement.

The variable gain amplifier which modifies the signal from the middle pick-up 73 is controlled by a preset maximum limit circuit 88 and a preset minimum limit 89 each of which is preadjusted to the maximum and minimum gain respectively. The adjustment of the amplification is controlled by the potentio-meter 61 which is connected in series with the limit circuit to the variable gain amplifier 79. In this manner the variation of the tone as well as the compensation for loss of volume is directly controlled by the player. FIG. 10 illustrates the compensation for the respective loss of volume caused by the shifting of the harp, as illustrated approximately by the gain curve on the graph.

We claim:

1. In a piano having a tone generator assembly and percussion means for generating tones on said assembly, a support for the tone generator assembly, mounting means for shiftably supporting said tone generator assembly on said support relatively to said percussion means, and manipulatable means connected to said mounting means for selectively shifting said assembly relatively to said percussion means at will thereby to alter the tone generated by the tone generators in said assembly, said mounting means including a pivotal connection between one end of said assembly and said support, the other end of said assembly being shiftable about said pivotal connection and resiliently yieldable means for urging said assembly into an initial playing position, said assembly having a treble end and a bass end and said pivotal connection being at the treble end.

2. The device specified in claim 1, and said manipulatable means being connected to said other end of said assembly.

3. In a piano having a tone generator assembly and percussion means for generating tones on said assembly, a support for the tone generator assembly, mounting means for shiftably supporting said tone generator assembly on said support relatively to said percussion means, and manipulatable means connected to said mounting means for selectively shifting said assembly relatively to said percussion means at will thereby to alter the tone generated by the tone generators in said assembly, electric sound producing means electronic pick-ups for the tone generators in said assembly, and means to translate vibration of the tone generators sensed by said pick-ups into signals driving said sound producing means, said means to translate vibration, including an amplifier circuit, and regulator means actuated by the shifting of said assembly to regulate the amplification by said amplifying circuit according to the extent of said shifting thereby to maintain the volume of sound substantially constant during the tone change caused by said shifting of said assembly.

4. The device specified in claim 3, and said amplifier circuit including a pre-amplifier circuit of high impedance with 180° phase change connected to said pick-ups, a variable gain amplifier circuit connected to said pre-amplifier, also having 180° phase change, said regulator means being operatively connected to said variable gain amplifier circuit for regulating the signal amplification.

5. The device specified in claim 4, and said assembly having a treble end and a bass end, and a mixing circuit, the signals from said variable gain amplifier being transmitted to said mixing circuit, tone generators at said treble end and said bass end being substantially unaffected by said shifting, and pick-ups at said unaffected tone generators being connected to said mixing circuit to be translated without pre-amplification mixed together with the amplified signals to said sound producing means.

6. In a piano having a tone generator assembly and percussion means for generating tones on said assembly, a support for the tone generator assembly, mounting means for shiftably supporting said tone generator assembly on said support relatively to said percussion means, and manipulatable means connected to said mounting means for selectively shifting said assembly relatively to said percussion means at will thereby to alter the tone generated by the tone generators in said assembly, said tone generator assembly including a frame, a front side, and a rear side spaced from one another, a bass end and a treble end, tone generator elements mounted between said sides in relation to said percussion means to be stricken on a predetermined striking line, said mounting means including .

pivotal connection between the treble end and said support, slidable connection between the bass end and said support.

7. The device specified in claim 6, and said manipulatable means being connected to said slidable connection.

8. The device specified in claim 6, and said manipulatable means including a manipulating element within reach of the player, and translating means for translating manipulation, applied to said manipulating element by the player, to shifting of said frame thereby changing the striking line on said tone generators.

* * * * *